US008590601B2

(12) United States Patent
Lee

(10) Patent No.: US 8,590,601 B2
(45) Date of Patent: Nov. 26, 2013

(54) SINTERED HEAT PIPE

(75) Inventor: Ke-Chin Lee, Taipei (TW)

(73) Assignee: Zhongshan Weiqianq Technology Co., Ltd. (CN)

( * ) Notice: Subject to any disclaimer, the term of this patent is extended or adjusted under 35 U.S.C. 154(b) by 1133 days.

(21) Appl. No.: 12/461,560

(22) Filed: Aug. 17, 2009

(65) Prior Publication Data

US 2010/0263833 A1 Oct. 21, 2010

(30) Foreign Application Priority Data

Apr. 21, 2009 (TW) ..... 98113162 A

(51) Int. Cl.
*F28D 15/00* (2006.01)

(52) U.S. Cl.
USPC ..... 165/104.26

(58) Field of Classification Search
USPC ..... 165/104.26
See application file for complete search history.

(56) References Cited

U.S. PATENT DOCUMENTS 3,786,861 A * 1/1974 Eggers ..... 165/104.26
3,911,547 A * 10/1975 Vinz ..... 165/104.26
4,196,504 A * 4/1980 Eastman ..... 165/104.26
4,274,479 A * 6/1981 Eastman ..... 165/104.26
4,366,526 A * 12/1982 Lijoi et al. ..... 361/700
4,903,761 A * 2/1990 Cima ..... 165/104.26
4,934,160 A * 6/1990 Mueller ..... 165/104.26
5,308,920 A * 5/1994 Itoh ..... 174/15.2
6,330,907 B1 * 12/2001 Ogushi et al. ..... 165/104.26
6,466,442 B2 * 10/2002 Lin ..... 165/104.33
6,793,009 B1 * 9/2004 Sarraf ..... 165/104.33
6,938,680 B2 * 9/2005 Garner et al. ..... 165/104.26
6,997,245 B2 * 2/2006 Lindemuth et al. ..... 165/104.26
7,013,958 B2 * 3/2006 Garner et al. ..... 165/104.26
7,040,382 B2 * 5/2006 Hsu ..... 165/104.26
7,134,485 B2 * 11/2006 Hul-Chun ..... 165/104.26
7,143,818 B2 * 12/2006 Thayer et al. ..... 165/104.26
7,293,601 B2 * 11/2007 Huang ..... 165/104.26
7,316,264 B2 1/2008 Lai et al.
7,472,479 B2 * 1/2009 Hou et al. ..... 29/890.032
7,520,315 B2 * 4/2009 Hou et al. ..... 165/104.26
7,527,762 B2 * 5/2009 Hou et al. ..... 165/104.26
7,543,629 B2 * 6/2009 Chin et al. ..... 165/104.21
7,552,759 B2 * 6/2009 Liu et al. ..... 165/104.26
7,726,384 B2 * 6/2010 Hou et al. ..... 165/104.26
7,845,394 B2 * 12/2010 Chang et al. ..... 165/104.26
7,866,374 B2 * 1/2011 Hou et al. ..... 165/104.26
8,021,023 B2 * 9/2011 Liu ..... 165/104.26
8,074,706 B2 * 12/2011 Su et al. ..... 165/104.26
8,201,618 B2 * 6/2012 Yu et al. ..... 165/104.26
8,235,096 B1 * 8/2012 Mahefkey et al. ..... 165/104.26

* cited by examiner

*Primary Examiner* — Ljiljana Ciric
(74) *Attorney, Agent, or Firm* — Bacon & Thomas, PLLC

(57) ABSTRACT

A sintered heat pipe having a metal tube of which an inner wall is formed with a plurality of capillary grooves extending in a longitudinal direction; and a sintered powder layer partially covering the capillary grooves. The sintered powder layer is circumferentially sintered onto the inner wall of the tube. The capillary grooves extend from one end of the metal tube but do not extend to the other end of the metal tube, leaving a section of the metal tube uncovered. The sintered powder layer extends from the other end of the metal tube but does not extend to the one end of the metal tube so as to cover the section of the metal tube uncovered by the capillary grooves.

2 Claims, 3 Drawing Sheets

A - A

SINTERED HEAT PIPE

BACKGROUND OF THE INVENTION

1. Field of the Invention

The present invention relates to a sintered heat pipe, especially to a heat pipe having capillary grooves formed on an inner wall of a tube and a sintered layer of metal powder partially covering the capillary grooves.

2. Brief Description of the Prior Art

It is known that a heat pipe is a device having a high heat transfer capability. Liquid medium filled in the heat pipe is evaporated at a hot segment into vapor, and the vapor moves at a high speed along a vapor passage toward a cold segment. Then, the vapor is condensed into liquid medium at the cold segment. Due to capillarity the liquid medium returns to the hot segment through the wick structure. In this manner, heat can be transferred promptly from the hot segment to the cold segment.

U.S. Pat. No. 7,316,264B2 has mentioned a heat pipe having a plurality of capillary grooves longitudinally or axially formed on the inner wall of the tube member, as shown in its FIGS. 5 and 6. As the liquid medium in the capillary grooves is exposed to vapor and the flow direction of the liquid medium is opposite to that of the vapor, the vapor moving toward cold segment will blow the liquid medium in the capillary grooves toward the cold segment. This will disadvantageously hinders the return of the liquid medium back to the hot segment.

U.S. Pat. No. 7,316,264B2 further proposes to cover such capillary grooves with a sintered metal powder layer or a metal mesh. However, under the condition that the capillary grooves is completely covered, the sintered metal powder layer or the metal mesh hinders the entry of the liquid medium into the capillary grooves.

SUMMARY OF THE INVENTION

In order to solve the above problem, the object of the present invention is to provide a heat pipe comprising a metal tube, a plurality of capillary grooves extending longitudinally being formed on an inner wall of the metal tube, and a sintered powder layer partially covering the capillary grooves. The metal tube has a first end and a second end. The capillary grooves extend from the first end to the second end or toward but to the second end. The sintered powder layer extends from the second end toward but not to the first end such that the sintered powder layer partially covers the capillary grooves.

In order to sintered powder layer partially cover the capillary grooves with the sintered powder layer, the length of the metal tube, the length of the sintered powder layer and the length of the capillary grooves are advantageously set to satisfy the following inequality.

$$(L+L1)>(L1+L2)>L$$

where L is the length of the metal tube, L1 is the length of the sintered powder layer, and L2 is the length of the capillary grooves.

DETAILED DESCRIPTION OF THE PREFERRED EMBODIMENTS

Now, the preferred embodiments according to the present invention will be described in conjunction with the accompanying drawings. For the convenience of description, the drawings are not in proportional to the practical dimensions.

FIG. 1 shows the first embodiment of the heat pipe according to the present invention in which the whole heat pipe is indicated by reference 10. FIG. 2 is a sectional view taken along A-A line in FIG. 1.

The heat pipe 10 comprises a hollow metal tube 11. A plurality of capillary grooves 12 extending longitudinally are formed on the inner wall of the metal tube 11. The capillary grooves 12 are partially covered by a sintered powder layer 13. Liquid medium is filled into the metal tube 11 under a low pressure or under vacuum. The metal tube 11 has a first end 14 and a second end 15.

The capillary grooves 12 extend from the first end 14 to the second end 15, leaving a section of the metal tube 11 extending from the second end 15 uncovered by the capillary grooves 12. The sintered powder layer 13 extends from the second end 15 toward but not to the first end 14 such that the sintered powder layer 13 covers the section of the metal tube 11 uncovered by the capillary grooves 12, and partially covers the capillary grooves 12. The sintered powder layer 13 is circumferentially sintered onto the inner wall of the tube 11, as shown in FIG. 2. In this embodiment the length L1 of the capillary grooves 12 is substantially equal to the length L of the metal tube 11, and the length L2 of the sintered powder layer 13 is smaller than the length L1 of the capillary grooves 12 such that the sintered powder layer 13 partially covers the capillary grooves 12. The partially covered length is indicated by Ls.

In the case that the capillary grooves are partially covered, the inequality L1>Ls>0 and the equation Ls=(L1+L2)−L are satisfied. Therefore, L, L1 and L2 must be selected to satisfy the inequality (L+L1)>(L1+L2)>L.

According to the present invention, the second end is preferably placed at the heat source when the heat pipe 10 is in use. In other words, the heat pipe according to the present invention has directivity. The liquid medium absorbs heat at the second end and is evaporated into vapor. The vapor moves toward the first end and is condensed into liquid medium at the first end side. Then, the liquid medium returns back to the second end side through the capillary grooves. Partially covering the capillary grooves with the sintered powder layer is advantageous in that the liquid medium in the capillary grooves is spaced from the vapor by the sintered powder layer such that the liquid medium flowing toward the second end in the capillary grooves is prevented from being blown toward the first end. In addition, the liquid medium condensed at the first side can enter the capillary grooves without any difficulty.

FIG. 3 shows the second embodiment of the heat pipe according to the present invention, in which the heat pipe is indicated by reference 20. It is different from the first embodiment in that the capillary grooves 22 extend from the first end 24 but not to the second end 25.

Once the liquid medium flows into the range of the sintered powder layer along the capillary grooves, the liquid medium is also adsorbed by the sintered powder layer due to capillarity. Thus, even if the capillary grooves fail to extend over the whole length of the metal tube, the heat transfer efficiency of the heat pipe would not be seriously affected.

FIG. 4 shows the third embodiment of the heat pipe according to the present invention, in which the heat pipe is indicated by reference 30. It is different from the first embodiment in that the thickness of the sintered powder layer 33 is variable. Specifically, the sintered powder layer 33 extends by a distance L3 with a constant thickness and then extends by a distance L4 with its thickness decreasing progressively toward the first end 34. In this embodiment, the capillary grooves 32 may not extend to the second end 35 as the second embodiment.

During operation of the heat pipe, the vapor pressure in the metal tube decreases progressively from the second end toward the first end such that the flow speed of vapor decreases after leaving the second end. In order to prevent the vapor which is slowed at the downstream of the vapor flow direction from blocking the advance of the vapor at the upstream of the vapor flow direction, it is advantageous to increase the cross sectional area of the vapor passage in the segment downstream of the vapor flow direction. Therefore, the thickness of the sintered powder layer is decreased progressively toward the first end, thereby the cross sectional area of the vapor passage is increased progressively. Progressive decreasing or increasing may be in a linear manner, a nonlinear manner or a step manner.

FIG. 5 shows the fourth embodiment of the heat pipe according to the present invention, in which the heat pipe is indicated by reference 40. It is different from the third embodiment in that the thickness of the sintered powder layer 43 decreases progressively from the second end 45 toward the first end 44. In this embodiment, the capillary grooves 42 may not extend to the second end 45 as the second embodiment.

In order to prevent the powder forming the sintered powder layer from filling into the capillary grooves before being sintered, the diameter of the powder particles for forming the sintered powder layer preferably greater than or equal to the width of the capillary grooves. The sintered powder layer may comprise a first sintered powder layer and a second sintered powder layer formed on a radially inward side of the first sintered powder layer, in which the diameter of the powder particles for forming the first sintered powder layer is greater than or equal to the width of the capillary grooves, and in which the diameter of the powder particles for forming the second sintered powder layer is smaller than the diameter of the powder particles for forming the first sintered powder layer. Preferably, the length of the first sintered powder layer is greater than the length of the second sintered powder layer such that the cross sectional area of the vapor passage increases progressively toward the first end. The sintered powder layer is formed by sintering one of copper powder, aluminum powder, nickel powder and carbon powder.

While this invention has been described with reference to the embodiments, it should be understood that various changes and modifications could be made within the spirit and scope of the inventive concepts described. Accordingly, it is intended that the invention shall not be limited to the disclosed embodiments but have the full scope permitted by the language of the following claims.

BRIEF DESCRIPTION OF THE ACCOMPANYING DRAWINGS

Figure 1:
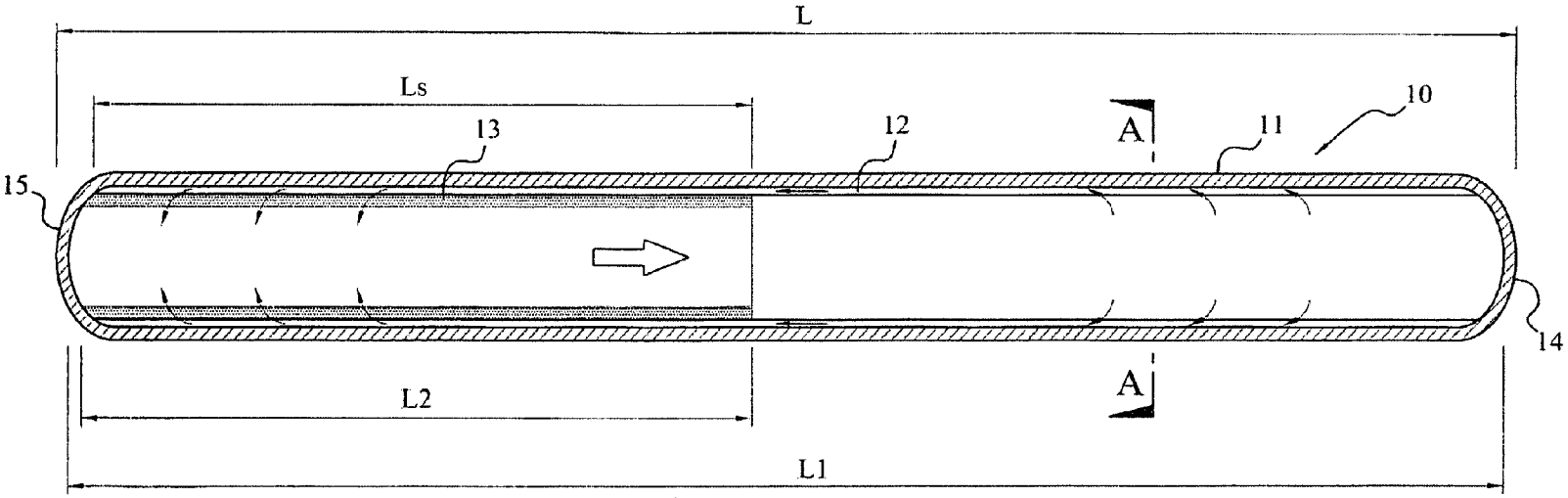
FIG. 1 shows the first embodiment of the heat pipe according to the present invention.
Figure 2:
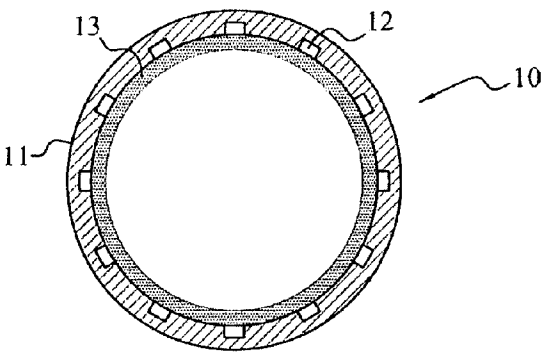
FIG. 2 is a cross sectional view showing the heat pipe of the first embodiment of the present invention.
Figure 3:
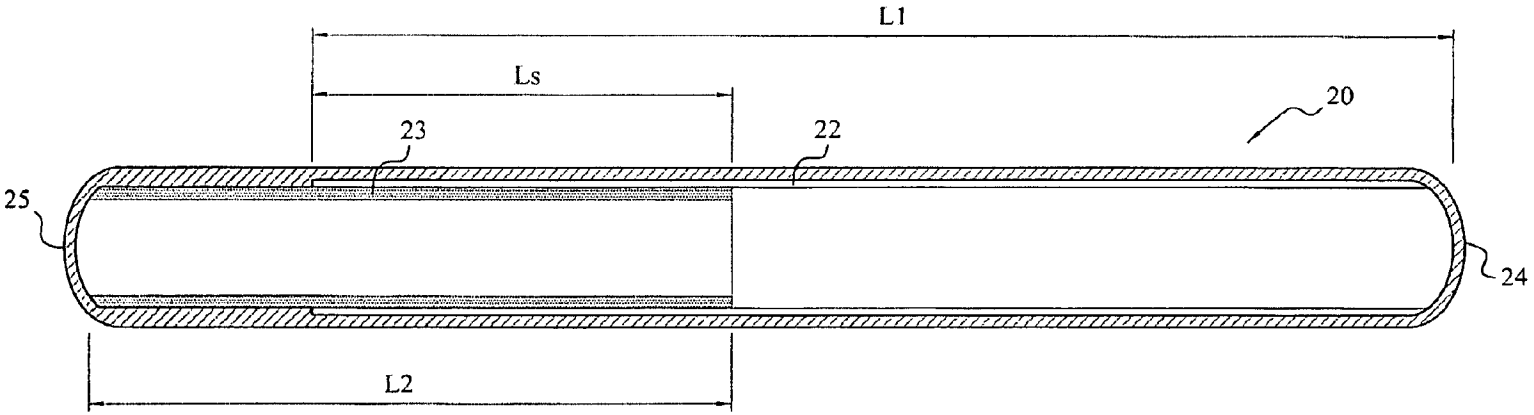
FIG. 3 shows the second embodiment of the heat pipe according to the present invention.
Figure 4:
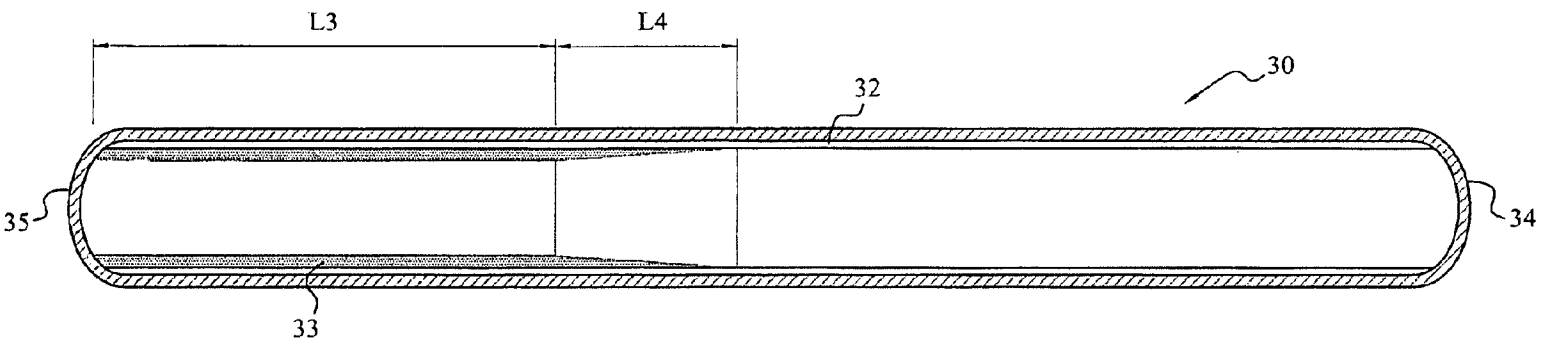
FIG. 4 shows the third embodiment of the heat pipe according to the present invention.
Figure 5:
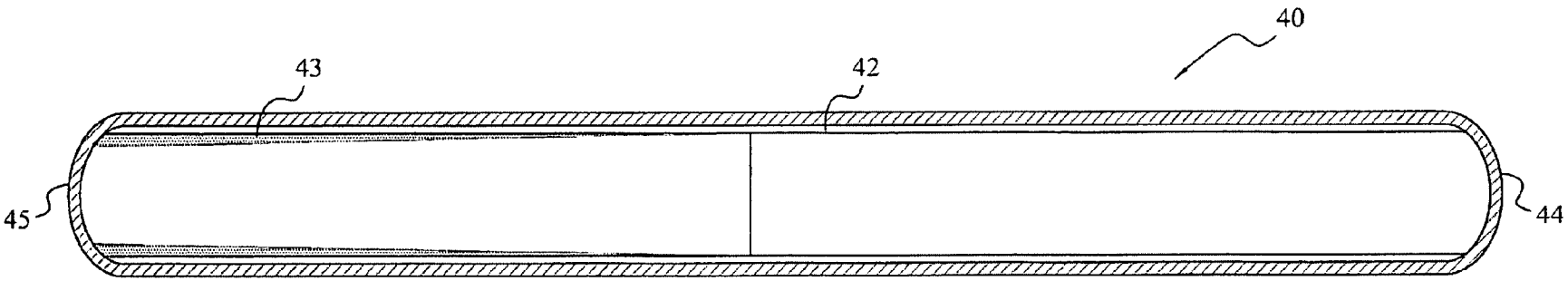
FIG. 5 shows the fourth embodiment of the heat pipe according to the present invention.

What is claimed is:

1. A sintered heat pipe comprising: a metal tube, a plurality of capillary grooves extending longitudinally being formed on an inner wall of said metal tube; and a sintered powder layer partially covering the plurality of capillary grooves, said sintered powder layer being circumferentially sintered onto the inner wall of the tube, wherein said metal tube has a first end and a second end, said plurality of capillary grooves extend from said first end and do not extend to said second end of the metal tube, thereby leaving a section of the metal tube extending from the second closed end uncovered by the plurality of capillary grooves, and said sintered powder layer extends from said second end and does not extend to said first end, thereby covering the section of the metal tube uncovered by the plurality of capillary grooves.

2. The sintered heat pipe according to claim 1, wherein said sintered powder layer is formed by sintering one of copper powder, aluminum powder, nickel powder and carbon powder.

* * * * *

UNITED STATES PATENT AND TRADEMARK OFFICE

CERTIFICATE OF CORRECTION

PATENT NO. : 8,590,601 B2
APPLICATION NO. : 12/461560
DATED : November 26, 2013
INVENTOR(S) : Ke-Chin Lee It is certified that error appears in the above-identified patent and that said Letters Patent is hereby corrected as shown below:

Title Page, Item (73) Assignee "Zhongshan Weiqianq Technology Co., Ltd." should read "Zhongshan Weiqiang Technology Co, Ltd."

Signed and Sealed this
Second Day of December, 2014

Michelle K. Lee

Michelle K. Lee
*Deputy Director of the United States Patent and Trademark Office*